US008057372B2

(12) United States Patent
Verheem

(10) Patent No.: US 8,057,372 B2
(45) Date of Patent: Nov. 15, 2011

(54) RESISTANCE CHAIR WITH WHEELS

(75) Inventor: Johann B. Verheem, Carlsbad, CA (US)

(73) Assignee: Fitness IQ LLC, Vista, CA (US)

( * ) Notice: Subject to any disclaimer, the term of this patent is extended or adjusted under 35 U.S.C. 154(b) by 0 days.

(21) Appl. No.: 12/939,238

(22) Filed: Nov. 4, 2010

(65) Prior Publication Data

US 2011/0086746 A1 Apr. 14, 2011

Related U.S. Application Data

(63) Continuation of application No. 12/792,570, filed on Jun. 2, 2010, now Pat. No. 7,850,586, which is a continuation of application No. 11/786,400, filed on Apr. 10, 2007, now Pat. No. 7,740,572.

(60) Provisional application No. 60/791,470, filed on Apr. 13, 2006, provisional application No. 60/793,650, filed on Apr. 21, 2006.

(51) Int. Cl.
*A63B 26/00* (2006.01)

(52) U.S. Cl. ..... 482/142; 482/96; 482/140

(58) Field of Classification Search ..... 482/92, 482/95, 96, 131, 132, 140, 142–148; 434/247
See application file for complete search history.

(56) References Cited

U.S. PATENT DOCUMENTS 5,580,340 A * 12/1996 Yu ..... 482/96
5,669,864 A * 9/1997 Brister ..... 482/132
2005/0181916 A1* 8/2005 Frost et al. ..... 482/140

* cited by examiner

*Primary Examiner* — Glenn Richman
(74) *Attorney, Agent, or Firm* — The Nath Law Group; Laurie A. Axford

(57) ABSTRACT

A resistance chair with wheels assists users with performing correct abdominal crunches by guiding the user's effort. The resistance chair includes a seat connected to a hinged back with back support that extends to support the user's back and assist in the crunch recovery following the crunch extension.

1 Claim, 2 Drawing Sheets

RESISTANCE CHAIR WITH WHEELS

CROSS-REFERENCE TO RELATED APPLICATIONS

This application is a continuation of U.S. patent application Ser. No. 12/792,570, filed Jun. 2, 2010, which is a continuation of U.S. patent application Ser. No. 11/786,400, filed Apr. 10, 2007, now U.S. Pat. No. 7,740,572, which claims priority from U.S. Provisional patent application 60/791,470, filed Apr. 13, 2006, and U.S. Provisional patent application 60/796,650 filed Apr. 21, 2006.

FIELD

The following description relates generally to the field of exercise equipment and more specifically to the field of low impact abdominal exercisers.

BACKGROUND

In an age of exercise and fitness, the time-honored abdominal crunch is under attack as potentially damaging if done incorrectly especially if performed by someone in poor physical condition. What is needed is an exercise tool to enable anyone to perform a correct abdominal crunch, and provide varying levels of resistance or assistance to accommodate people unaccustomed to exercise.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

A resistance chair with wheels assists users with performing correct abdominal crunches by guiding the user's effort and eliminating the initial jerking motion commonly experienced when doing an abdominal crunch. The resistance chair includes a seat connected to a hinged back with back support that extends to support the user's back and assist in the crunch recovery following the crunch extension.

In operation, a resistance chair provides support for a user's back, adjustable resistance moving from the start position to the extended position thus exercising muscles that ordinarily don't receive work in abdominal crunches. The back support and the adjustable resistance of the resistance chair also assist the user by overcoming a portion of gravity to help the user perform a correct crunch moving from the extended position to the start position.

By providing resistance to the backwards movement, the user engages the lower back muscles and thereby exercises the front and the back of the abdominal muscles. The backrest further permits core rotation providing the user the ability to do a sideways twist and engage the oblique muscles.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
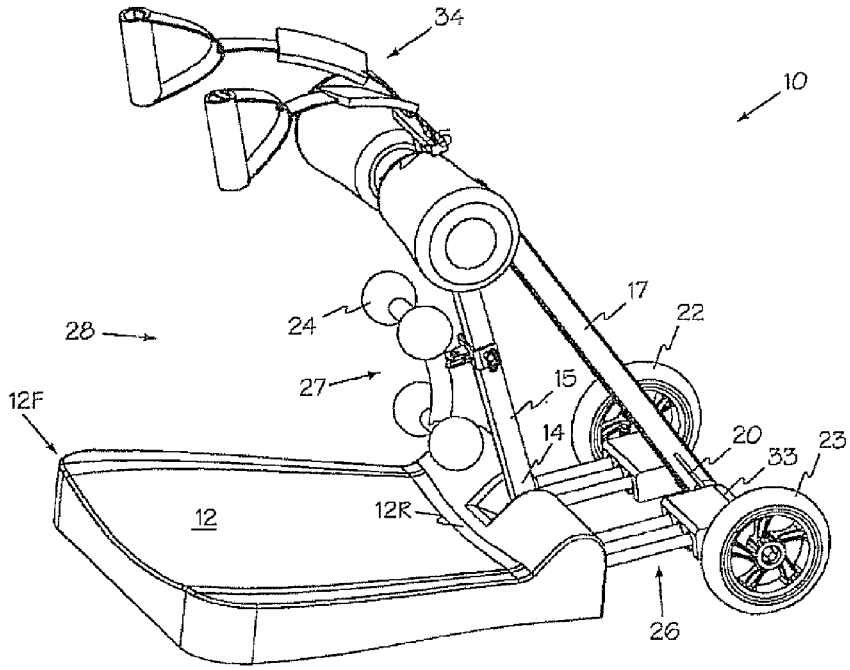
FIG. 1 is a perspective view of a resistance chair in the starting position.
Figure 2:
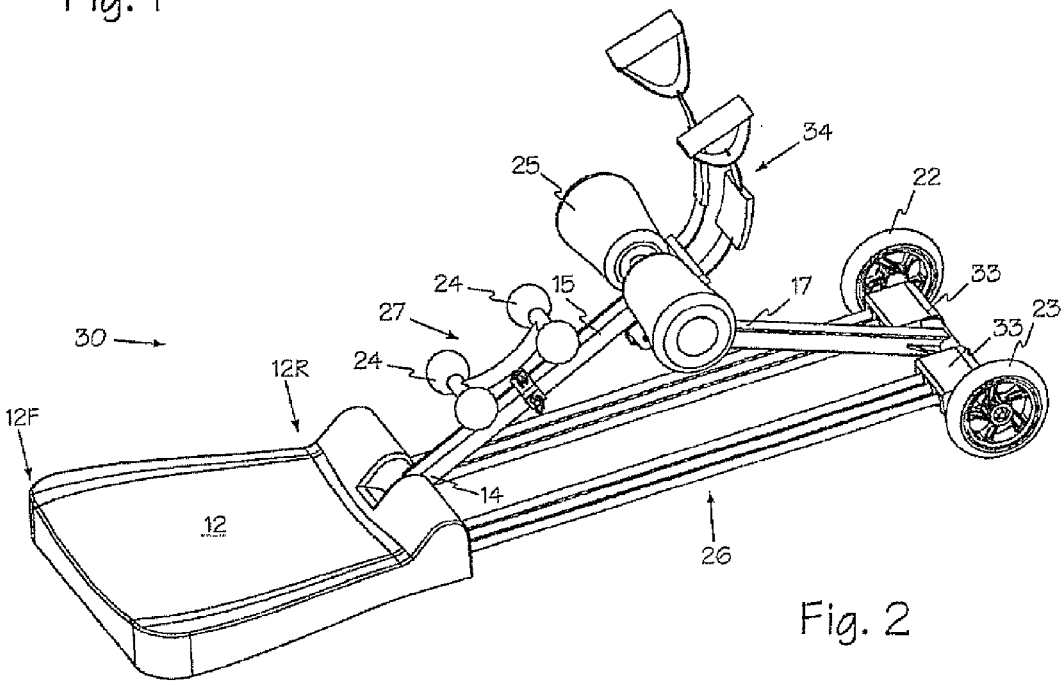
FIG. 2 is a perspective view of the resistance chair of FIG. I in the extended position.
Figure 3:
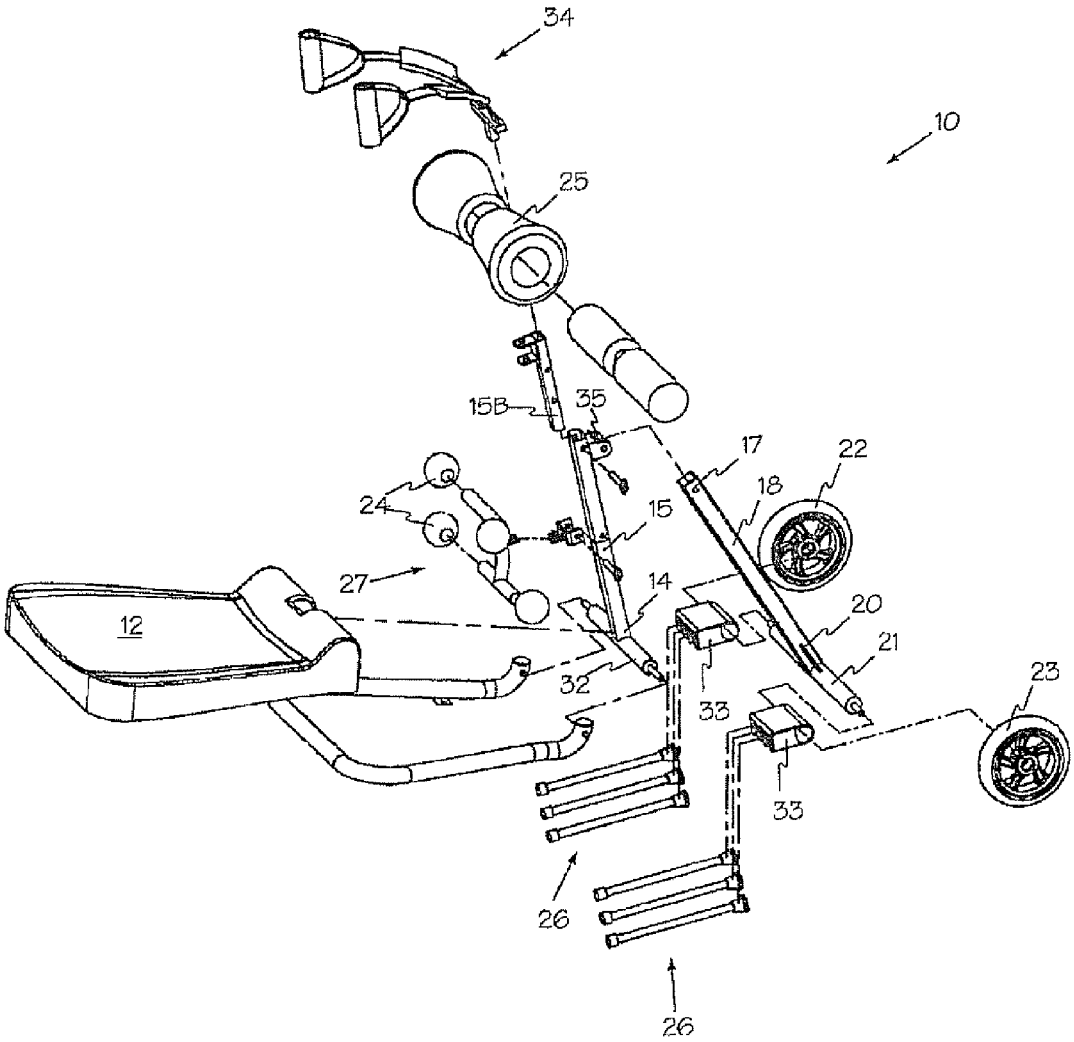
FIG. 3 is an exploded view of the resistance chair of FIG. 1.

Referring to FIG. 1 and FIG. 3, resistance chair 10 includes seat 12 pivotally secured to first end 14 of first arm 15 which is pivotally secured to second end 17 of second arm 18. First end 20 of the second arm engages axle 21 and any suitable wheels such as wheels 22 and 23 may be secured to axle 21 to enable extension of resistance chair 10 to extended position 30 as illustrated in FIG. 2. Any suitable back support elements such as rollers 24 and or shoulder support 25 may be secured to first arm 15. Rollers 24 may be secured at any suitable position on first arm 15 and may be included in a backrest such as backrest 27 that may swivel at the point of attachment to first arm 15. Seat 12 may be molded plastic, metal, foam or a combination of wood, steel and upholstery. Front edge 12F may be higher relative to rear edge 12R to place a user at a slight incline into the back support. This position ensures optimal comfort when performing an abdominal crunch.

One or more resistance bands such as bands 26 may be used to provide selectable resistance to a user moving from start 20 position 28 of FIG. 1 to extended position 30 of FIG. 2. The resistance bands also assist the user to perform a correct crunch motion when moving from extended position 30 to start position 28. Resistance bands 26 may be secured between axle 21 and axle 32 using any suitable technique such as band engagement elements 33 directly secured to axle 21 and seat 12 secured to axle 32.

Optional shoulder straps 34 may be attached to hinge 35 between first arm 15 and second arm 18 or to an extension such as extension 15B from first arm 15. Straps 34 may provide additional resistance to a user seeking to extend the crunch position and continue to move their upper body forward past start position 28. This extends the crunch, contracts the user's abdominal muscles farther than the start position and engages the user's arms in the exercise.

In use a user sits upon seat 12 with the user's back adjacent to back rollers 24 in start position 28 of FIG. 1. The user must lean back against the back rollers 24 and shoulder support 25 using the user's back muscles to push against the back rollers 24 and shoulder support 25. Wheels 22 and 23 will begin to roll away from the user and permit first arm 15 and 10 second arm 18 to fold to a horizontal position parallel to the ground as in extended position 30 of FIG. 2. The transition from start position 28 of FIG. 1 to extended position 30 of FIG. 2 stretches resistance bands 26. The energy stored in stretched resistance bands 26 counteracts a portion of the gravitational force on the user's upper body and assists the user to perform an abdominal crunch to return the user's upper body from the extended position 30 of FIG. 2 to at least start position 28 of FIG. 1. By performing these movements the user is doing an abdominal crunch with back support and resistance that stretches the lower back muscles, forces the user to use more muscles when pushing backwards, and supporting the user when the user moves from the fully extended position to the upright start position, thereby creating a more comfortable, efficacious exercise.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

What is claimed is:

1. A resistance chair comprising:

a stationary seat having a front edge and a back edge;

an arm rotatably engaging the back edge of the seat;

at least one back support secured to the arm and supporting the back of a user sitting on the stationary seat; and at least one resistance element connected to the stationary seat;

wherein the at least one resistance element urges the first arm to an upright start position and assists a user performing an abdominal crunch to return to an upright abdominal crunch position from a fully extended abdominal crunch position; and wherein the at least one resistance element resists rotation of the first away from the upright start position and resists against the user moving from the upright abdominal crunch position to the fully extended abdominal crunch position.

* * * * *